US006764023B2

(12) United States Patent
Peng et al.

(10) Patent No.: US 6,764,023 B2
(45) Date of Patent: Jul. 20, 2004

(54) BI-DIRECTION PUMPING DROPLET MIST EJECTION APPARATUS

(75) Inventors: Yu-Yin Peng, Hsinchu (TW); Pin-Yung Tu, Shinjuang (TW); Chia-Lin Wu, Taoyuan Hsien (TW); Tien-Ho Gau, Hsinchu (TW); Yeau-Ren Jeng, Tainan (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 0 days.

(21) Appl. No.: 10/266,564

(22) Filed: Oct. 9, 2002

(65) Prior Publication Data

US 2004/0069864 A1 Apr. 15, 2004

(51) Int. Cl.[7] ..... B05B 1/08
(52) U.S. Cl. ..... 239/101; 239/102.2
(58) Field of Search ..... 239/101, 102.1, 239/102.2, 4, 589.1, 590.3, 596

(56) References Cited

U.S. PATENT DOCUMENTS 5,072,240 A * 12/1991 Miyazawa et al. ..... 347/22
5,518,179 A * 5/1996 Humberstone et al. .. 239/102.2
6,116,517 A 9/2000 Heinzl et al.
6,256,884 B1 * 7/2001 Takeuchi et al. ..... 29/890.143
6,474,566 B1 * 11/2002 Hirota et al. ..... 239/102.2
6,598,950 B1 * 7/2003 Hosono et al. ..... 347/11
6,626,524 B2 * 9/2003 Okazawa et al. ..... 347/68
2001/0012029 A1 * 8/2001 Momose ..... 347/30

FOREIGN PATENT DOCUMENTS

EP 000595758 A1 * 5/1994

* cited by examiner

*Primary Examiner*—William E. Tapolcai
*Assistant Examiner*—Mohammad M. Ali
(74) *Attorney, Agent, or Firm*—Birch, Stewart, Kolasch, & Birch, LLP

(57) ABSTRACT

A bi-direction pumping droplet mist ejection apparatus includes a casing which has two sides each has an inlet and a plurality of nozzle orifices, and a piezoelectric plate located in the casing and clamped and anchored by a clamping pad on one end thereof. The casing has a reservoir and an ejection chamber located on each of two sides of the piezoelectric plate. The reservoir and the ejection chamber are interposed by flow guiding slant surfaces and buffer edges to enable the piezoelectric plate and the nozzle orifices to form a gap therebetween to cerate nozzle and dispersion effects so that after the piezoelectric plate is activated fluid may be ejected evenly through the nozzle orifices on two sides to generate even fuel ejection and a desired atomization effect in a bi-direction fashion.

17 Claims, 7 Drawing Sheets

BI-DIRECTION PUMPING DROPLET MIST EJECTION APPARATUS

FIELD OF THE INVENTION

The present invention relates to a droplet mist ejection apparatus and particularly a droplet mist ejection apparatus that employs micro electromechanical and piezoelectric techniques and materials to deflect a piezoelectric plate to enable fluid in a casing be pumped and ejected evenly in two directions.

BACKGROUND OF THE INVENTION

In general, before fuel is channeled into cylinders for combustion, it must be undergone a carburetion or atomizing process to mix with air to become a mixture of a desired proportion to facilitate combustion. However in the design of conventional carburetors, fuel is sucked by air due to Venturi effect and is ejected through fixed nozzles in one direction. Such a design has drawbacks, notably: fuel supply is difficult to control precisely, and atomizing of the fuel in not evenly done and ejection tends to concentrate unevenly.

Some conventional fluid mist ejection apparatus have a piezoelectric plate located in a chamber. A voltage pulse excursion is input to deflect and deform the piezoelectric plate thereby to control flow out pattern and atomization of the fluid in the casing. Such a design may be adopted on general atomizing devices or burners. For instance, U.S. Pat. No. 6,116,517, as shown in FIG. 1A, discloses a droplet mist generator that has a fluid inlet 1 located on one lateral side of a casing 2*a* and a plural arrays of nozzle orifices 3 located on another side of the casing 2*a* to form a circulating flow passage. There is a piezoelectric flexural transducer 4 with one end anchored on an inner wall of the casing 2*a* and another end being a free end. By means of a control unit, the piezoelectric flexural transducer 4 may be deflected and deformed towards the direction of nozzle orifices 3 (as shown in FIG. 1B) to enable the fluid be ejected out through the nozzle orifices 3 in one direction. However, the piezoelectric flexural transducer 4 cannot closely cover the nozzle orifices 3 during deflection, and a fluid ejection differential pressure occurs and the atomization effect and ejection amount are affected. As a result, ejecting efficiency suffers. Moreover, the chamber is relatively large size and is difficult to generate a greater ejection pressure. This also affects the atomization effect. The cited patent also discloses another ejection embodiment as shown in FIG. 2A. It also has an inlet 1 located on one side of the casing 2*b* and nozzle orifices 3 located on another side of the casing 2*b*, and a piezoelectric flexural transducer 4 with one end anchored on an inner wall of the casing 2*b* and another end being a free end. And by means of a control unit, the piezoelectric flexural transducer 4 may be deflected and deformed to close the nozzle orifices 3 extended from the inner wall of the casing 2*b* (as shown in FIG. 2B). However, the gap between the piezoelectric flexural transducer 4 and the nozzle orifices 3 are not symmetrical or evenly formed. As a result, fluid is not evenly ejected through the gaps. Therefore it can be used only as a constant closed valve, but cannot be used as a pump.

SUMMARY OF THE INVENTION

The primary object of the invention is to provide a bi-direction pumping droplet mist ejection apparatus that enables fluid be ejected through nozzle orifices in two directions and to achieve an improved atomization effect.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1A:
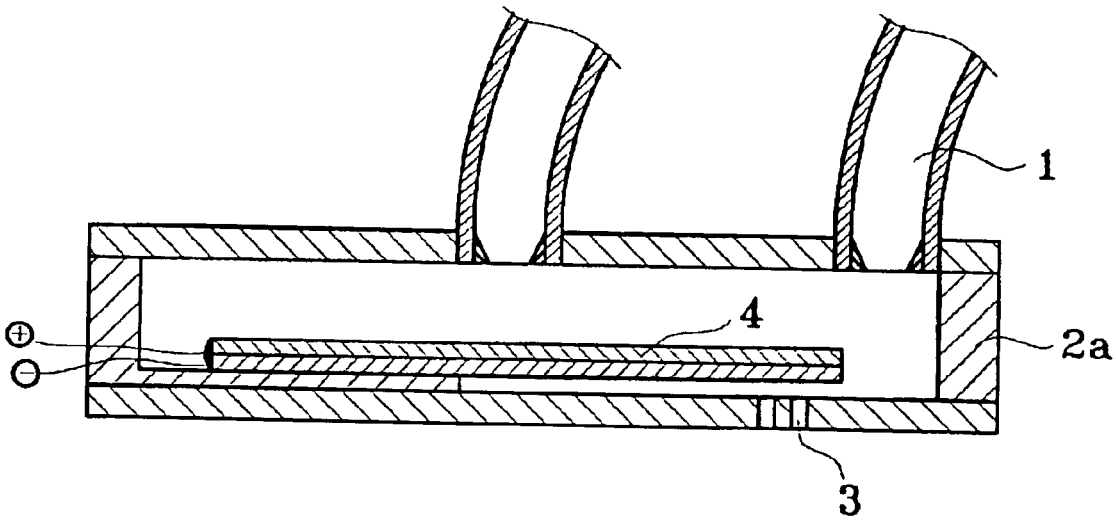
Fig.1A PRIOR ART
FIGS. 1A and 1B are fragmentary schematic views of a conventional ejection apparatus in operating conditions.
Figure 1B:
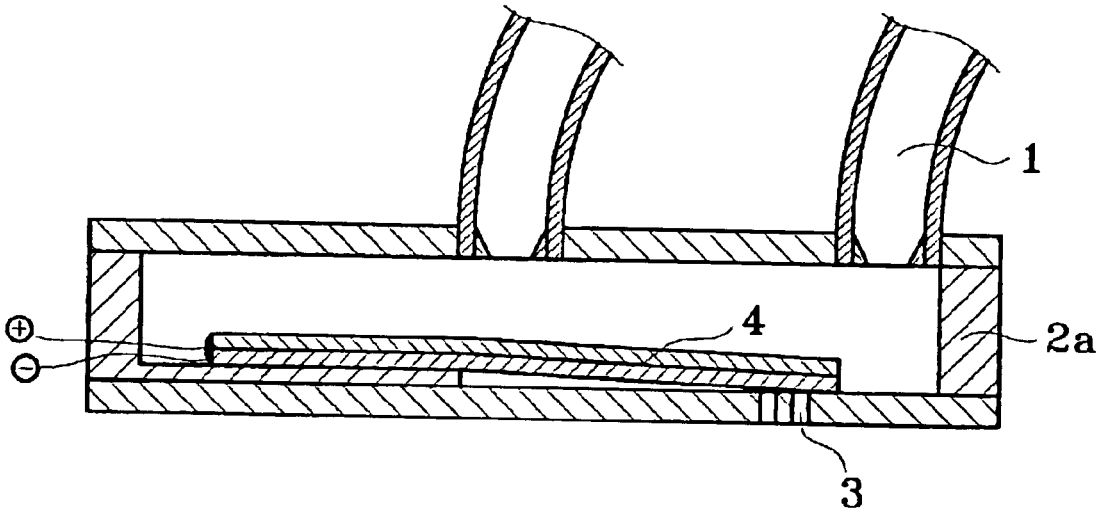
Fig.1B PRIOR ART
Figure 2A:
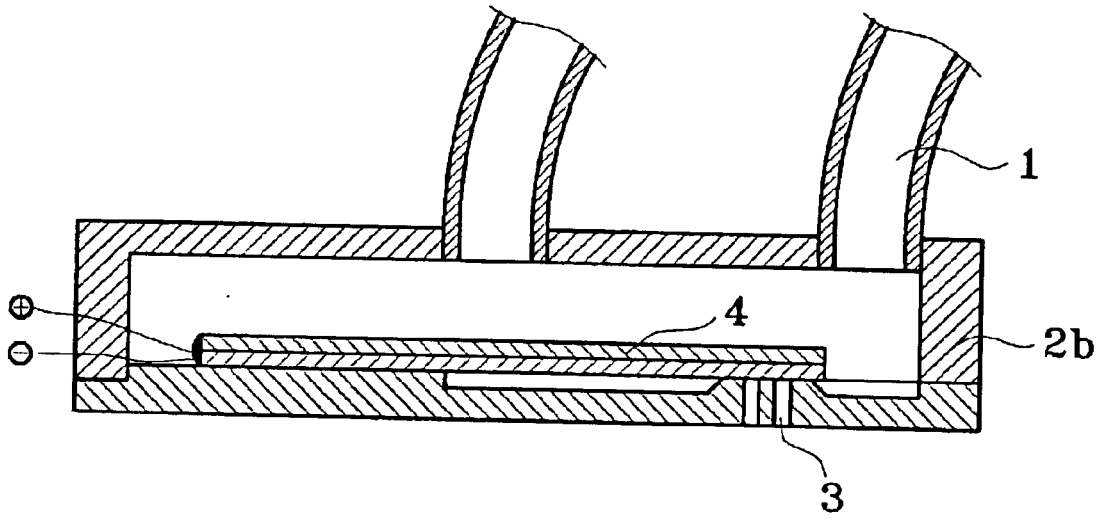
Fig.2A PRIOR ART
FIGS. 2A and 2B are fragmentary schematic views of another conventional ejection apparatus in operating conditions.
Figure 2B:
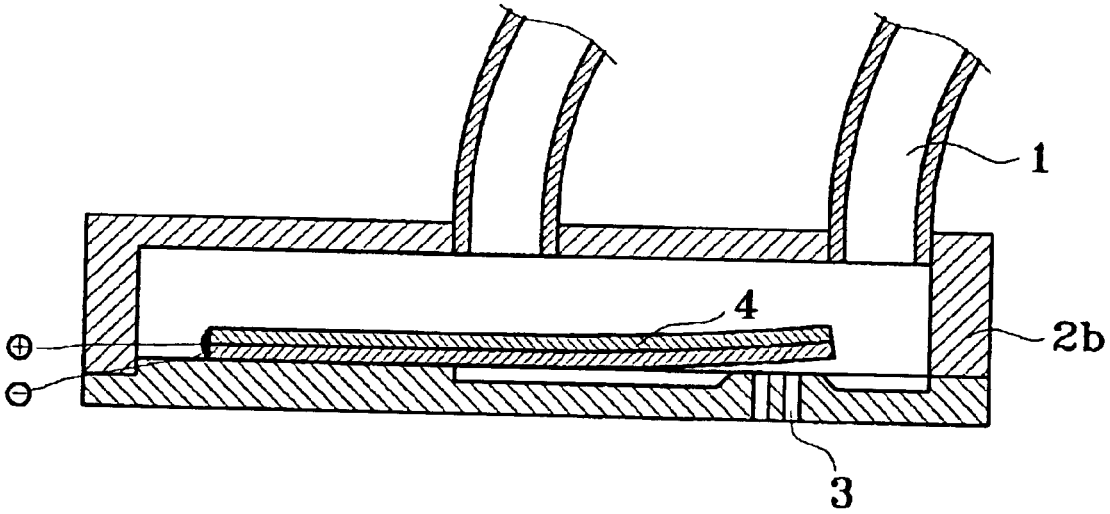
Fig.2B PRIOR ART

Referring to FIGS. 3 through 7, the bi-direction pumping droplet mist ejection apparatus of the invention includes a casing 10 which has two sides each has an inlet 14 and a plurality of nozzle orifices 17 located thereon, a piezoelectric plate 20 and a pair of clamping pads 30.

The casing 10 is rectangular and has a housing compartment 11 formed in the interior. The casing 10 has a first wall 12 and a second wall 13 opposite to each other that have respectively one end with one inlet 14 formed thereon for receiving fluid into the housing compartment 11. The housing compartment 11 includes a reservoir 111 and an ejection chamber 112 located in this order from the inlet 14. The cross section from the reservoir 111 to the ejection chamber 112 is stepwise and tapered on the portion of the ejection chamber 112. There are three flow guiding slant surfaces 15A, 15B and 15C located between the reservoir 111 and the ejection chamber 112 to form nozzle and dispersion orifices effects to facilitate fluid replenishment. The ejection chamber 112 has a bottom section formed a pressure equalization chamber 16. The pressure equalization chamber 16 neighboring to nozzle orifices 17 which run through a nozzle plate 50. The nozzle orifices 17 are arranged in an array fashion and are spaced from one another in desired distances. The nozzle orifices 17 run through the casing 10 and are formed by laser drilling, ion bombardment, or other desired micro electromechanical techniques. There are buffer edges 18A, 18B and 18C formed between the pressure equalization chamber 16 and the flow guiding slant surfaces 15A, 15B and 15C. The buffer edges 18A, 18B and 18C and the flow guiding slant surfaces 15A, 15B and 15C jointly create nozzle effect and function as an one-way check valve such that the ejected fluid does not flow back to the reservoir 111, and most of the fluid are ejected out through the nozzle orifices.

The piezoelectric plate 20 consists of a plurality of thin steel sheets and materials that have piezoelectric property. The piezoelectric plate 20 is located in the center of the housing compartment 11 and has an anchor end 21 and a free end 22. The anchor end 21 is located on one end of the casing remote from the inlet 14 and is connected to an input port 23. The input port 23 may receive voltage pulse signals from a control unit to actuate the piezoelectric plate 20. After the piezoelectric plate 20 is installed in the housing compartment 11, the free end 22 is suspended on the flow guiding slant surfaces 15A to couple with the pressure equalization chamber 16 and the buffer edges 18A, 18B and 18C so that when the piezoelectric plate 20 is actuated, the piezoelectric plate 20 does not contact the nozzle orifices 17. Thus the piezoelectric plate 20 may be prevented from directly hitting the nozzle plate 50 and to avoid damaging the liquid film pad formed thereon. In addition, when the piezoelectric plate 20 is returned, the adhering force occurred on the piezoelectric plate 20 may be reduced to generate the pumping effect in another direction to increase operation frequency.

The clamping pads 30 clamp the anchor end 21 of the piezoelectric plate 20 to enable the piezoelectric plate 20 be fixedly located in the housing compartment 11 of the casing 10. The clamping pads 30 may be made from polymers to insulate the piezoelectric plate 20 from the casing 10, and to securely anchor the piezoelectric plate 20.

Figure 3:
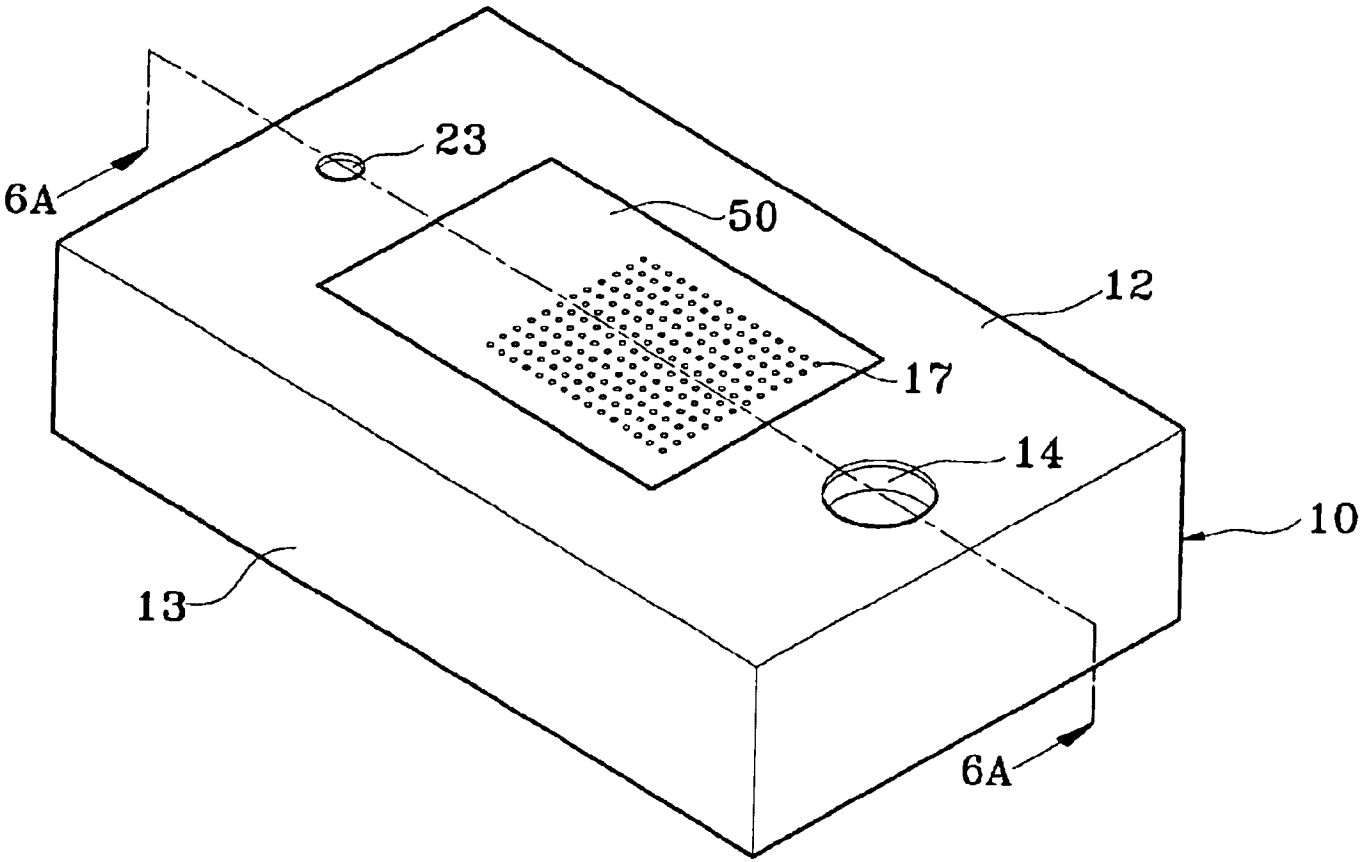
FIG. 3 is a perspective view of a droplet mist ejection apparatus of the invention.
Figure 4:
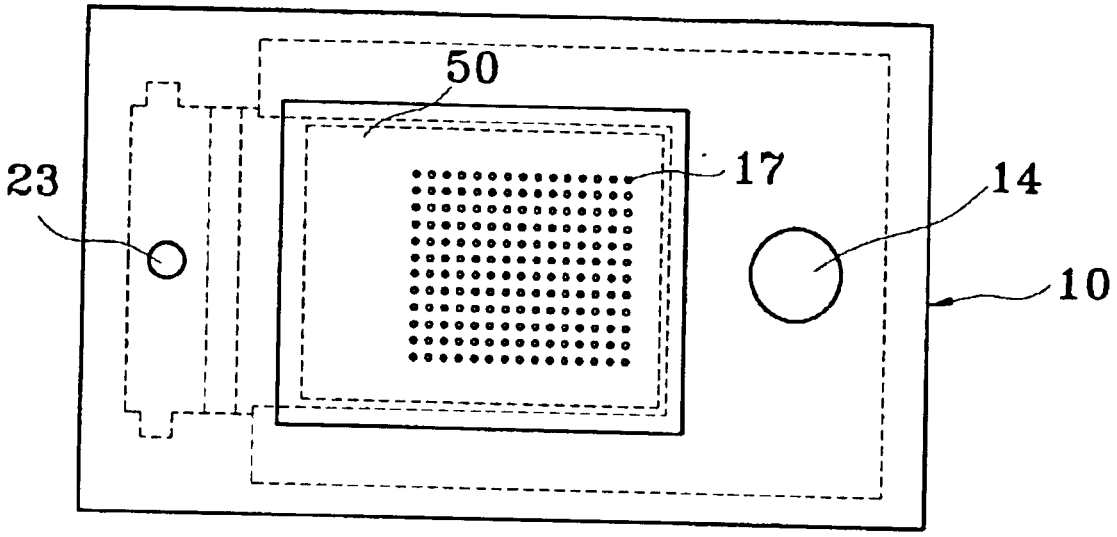
FIG. 4 is a top view of a droplet mist ejection apparatus of the invention.
Figure 5:
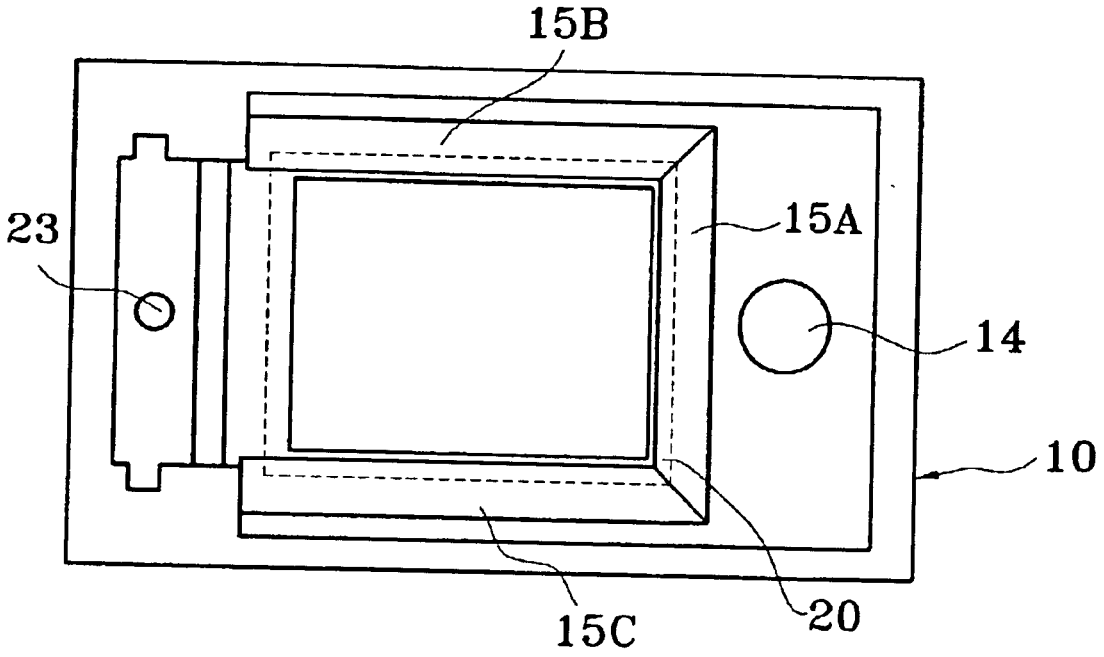
FIG. 5 is another top view of a droplet mist ejection apparatus of the invention.
Figure 7:
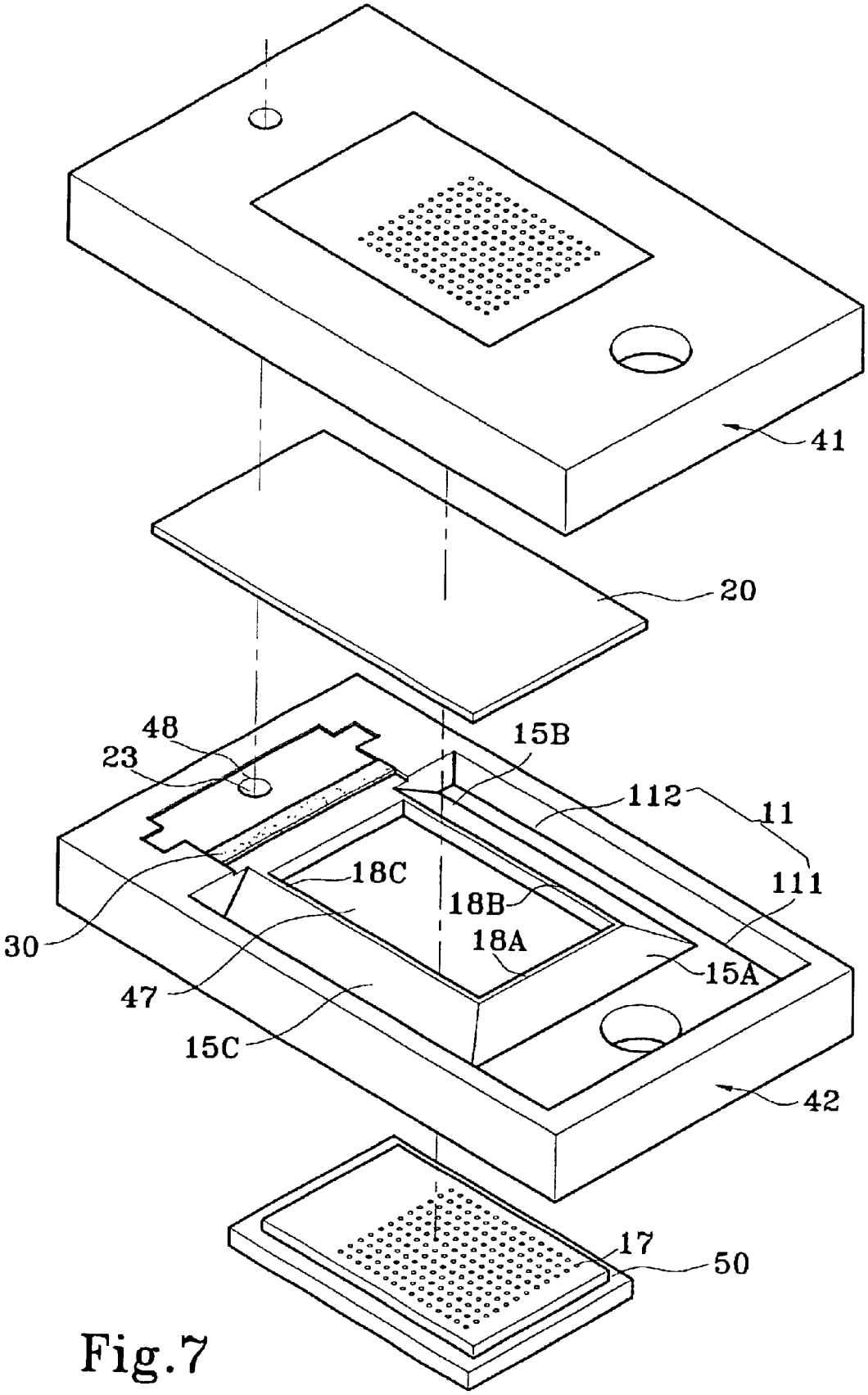
FIG. 7 is an exploded view of the droplet mist ejection apparatus of the invention.
Figure 8:
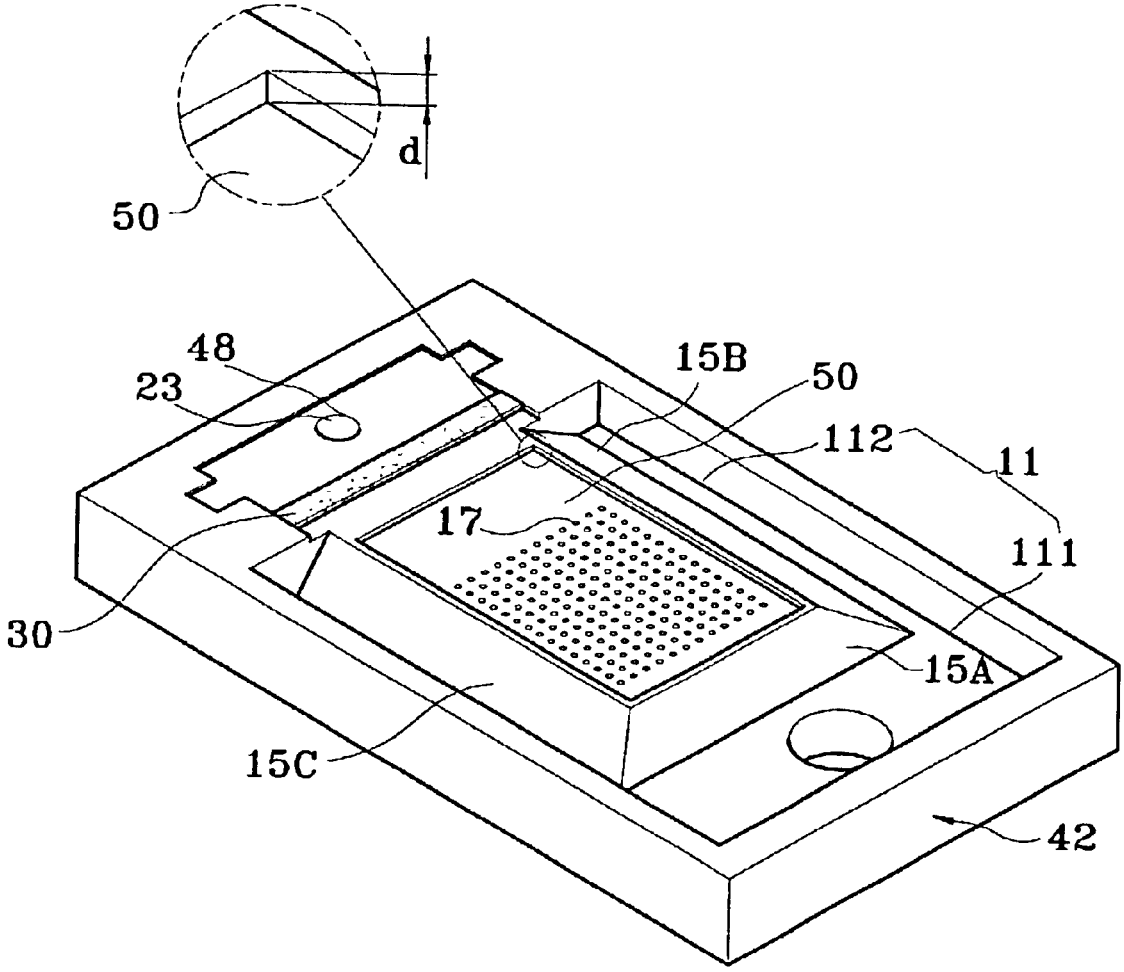
FIG. 8 is a fragmentary perspective view of the droplet mist ejection apparatus of the invention

Refer to FIG. 7 for making processes of an embodiment of the invention. First, fabricate an upper substrate 41 and a lower substrate 42. Then clamp a piezoelectric plate 20 between the upper substrate 41 and the lower substrate 42, and bond the upper substrate 41 and the lower substrate 42 together. Thereafter, encase the bonded the upper substrate 41 and the lower substrate 42 in a casing 43 to form the droplet mist ejection apparatus (as shown in FIG. 3). The upper substrate 41 and the lower substrate 42 are similarly formed. In the fabrication processes, first, form a rectangular and stepwise housing compartment 11 in the coupled upper substrate 41 and the lower substrate 42. The housing compartment 11 includes a reservoir 111 and an ejection chamber 112. The reservoir 111 has a depth greater than that of the ejection chamber 112 and is located on one end of the upper substrate 41 and the lower substrate 42. The ejection chamber 112 and the reservoir 111 are joined on one side which forms a slant surface 15A. The slant surface 15A is adjacent to two neighboring sides which also are formed slant surfaces 15B and 15C. The ejection chamber 112 has a bottom section formed a through stepwise rectangular cavity 47 such that three buffer edges 18A, 18B and 18C are formed on the bottom section of the ejection chamber 112 between the slant surfaces 15A, 15B and 15C and the rectangular cavity 47. The bottom section of the reservoir 111 has a through inlet 14. The housing compartment 11 has another end remote from the reservoir 111 formed a cavity to house a clamping pad 30. The upper substrate 41 and the lower substrate 42 has one end remote from the reservoir 111 formed a through hole 48 to house the input port 23. A nozzle plate 50 formed in a stepwise manner is provided. The nozzle plate 50 has a plurality of through nozzle orifices 17 formed on one end nearby the free end of a piezoelectric plate 20 and are arranged in an array fashion. The nozzle plate 50 is housed in the rectangular cavity 47 from outside and is spaced from the bottom surface of the ejection chamber 112 at a gap d to form a pressure equalization chamber 16 (as shown in FIG. 8). Then the piezoelectric plate 20 is disposed between the upper substrate 41 and the lower substrate 42 in parallel with the nozzle plate 50. The piezoelectric plate 20 has one end clamped and anchored by a clamping pad 30 and connected to the input port 23, and a free end 22 located above the slant surfaces 15A, 15B and 15C. The ejection apparatus of the invention may also be formed in an integrated manner.

The design of the ejection chamber 112 and the pressure equalization chamber 16 is such that there is a gap between the piezoelectric plate 20 and the nozzle orifices 17 to form an ejection chamber of a very small gap to provide a greater ejection pressure, and thereby to achieve an improved atomizing effect and a greater ejection amount. By increasing the height of the ejection chamber 112 and the pressure equalization chamber 16, a greater ejection pressure may be obtained. In addition, the piezoelectric plate 20 receives forces symmetrically and is subject to same type of reciprocal motion. As a result, life span and ejection efficiency may increase.

Figure 6A:
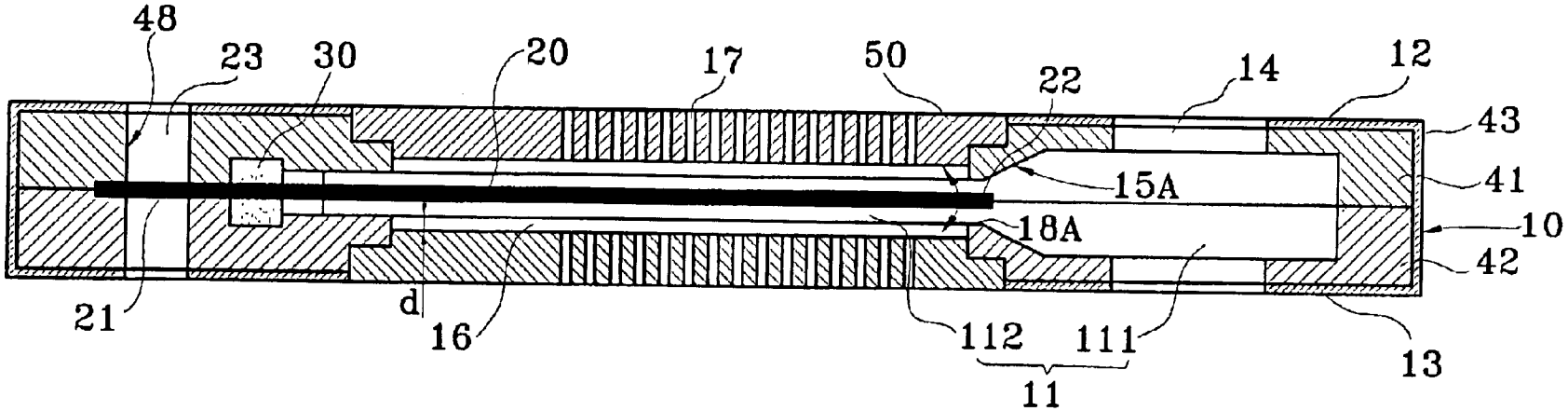
FIG. 6A is a cross section taken along line 6A—6A in FIG. 3.
Figure 6B:
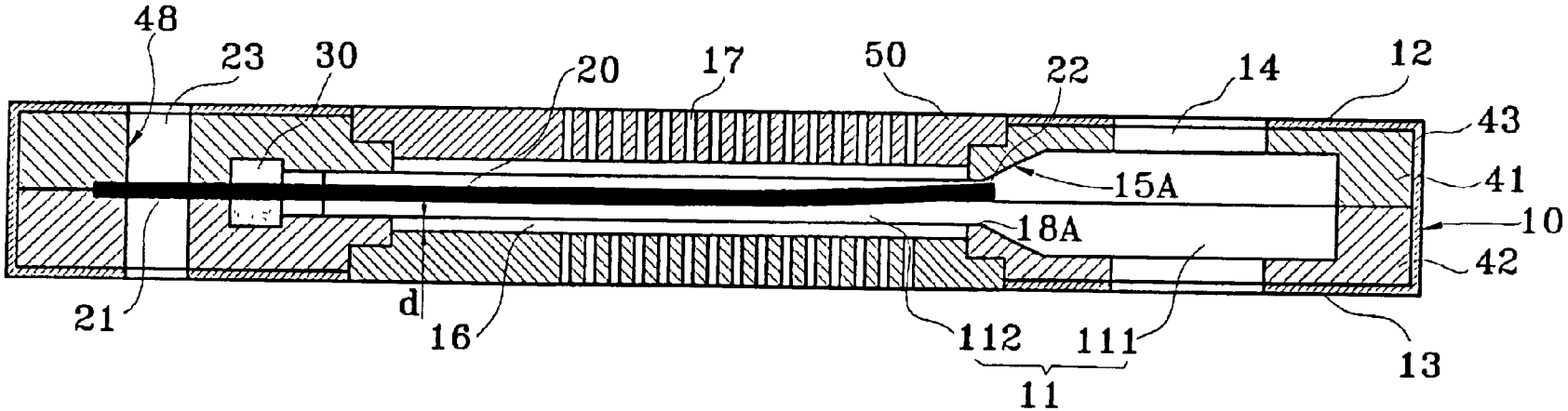
FIG. 6B is a schematic view of the droplet mist ejection apparatus of the invention in an operating condition.

Refer to FIGS. 6A and 6B for the droplet mist ejection apparatus of the invention in operation. The fluid flows through the inlet 14 into the reservoir 111, and flows in one direction over the flow guiding slant surfaces 15A, 15B and 15C to the pressure equalization chamber 16 and the nozzle orifices 17. Because of liquid surface tension during flowing in the casing, the fluid fills in various small passages in the casing (nozzle orifices 17, ejection chamber 112, pressure equalization chamber 16, and reservoir 111). When the input port 23 controls and actuates the piezoelectric plate 20, the piezoelectric plate 20 deflects inwards to one side and the fluid is ejected out through the ejection chamber 112, pressure equalization chamber 16 and nozzle orifices 17. In the mean time, fluid is directed into the ejection chamber 112 over the flow guiding slant surfaces on another side of the piezoelectric plate 20. When the piezoelectric plate 20 receives signals for inverse movements, the fluid is ejected out through the nozzle orifices 17. The operations may be repeatedly proceeded to form a bi-direction pumping ejection process and to achieve atomization effect.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A bi-direction pumping droplet mist ejection apparatus, comprising:

a casing having a first wall, a second wall and a housing compartment, the first wall and the second wall being opposite to each other and having respectively an inlet formed on one end thereof, the housing compartment including a reservoir, an ejection chamber and a pressure equalization chamber, the reservoir and the ejection chamber being interposed by flow guiding slant surfaces and buffer edges;

a plurality of nozzle orifices run through the first wall and the second wall;

a piezoelectric plate located in the housing compartment having a free end and an anchor end; and a clamping pad anchored on an inner wall of the casing for clamping the anchor end of the piezoelectric plate.

2. The bi-direction pumping droplet mist ejection apparatus of claim 1, wherein the piezoelectric plate is located in the center of the housing compartment.

3. The bi-direction pumping droplet mist ejection apparatus of claim 1, wherein the anchor end of the piezoelectric plate connects to an input port.

4. The bi-direction pumping droplet mist ejection apparatus of claim 1, wherein the piezoelectric plate is spaced from the nozzle orifices for a desired gap.

5. The bi-direction pumping droplet mist ejection apparatus of claim 1, wherein the reservoir communicates with the inlet, and is spaced from the ejection chamber to form a cross section of a tapered and stepwise fashion.

6. The bi-direction pumping droplet mist ejection apparatus of claim 1, wherein the free end of the piezoelectric plate is at the same side of the inlet.

7. The bi-direction pumping droplet mist ejection apparatus of claim 1, wherein the nozzle orifices are spaced from one another at desired distances and are arranged in an array fashion.

8. The bi-direction pumping droplet mist ejection apparatus of claim 1, wherein the clamping pad is made from polymers.

9. The bi-direction pumping droplet mist ejection apparatus of claim 1, wherein the nozzle orifices are located on two corresponding walls of the reservoir and run through the casing.

10. The bi-direction pumping droplet mist ejection apparatus of claim 1, wherein the piezoelectric plate consists of a plurality of steel sheets and thin metal sheets that have piezoelectric property.

11. The bi-direction pumping droplet mist ejection apparatus of claim 1, wherein the reservoir and the ejection chamber are interposed by three flow guiding slant surfaces to create nozzle and dispersion effects between the ejection chamber and the reservoir.

12. A bi-direction pumping droplet mist ejection apparatus, comprising:

an upper substrate and a lower substrate coupling to form a rectangular and stepwise housing compartment;

a nozzle plate run through by a plurality of nozzle orifices; and a piezoelectric plate located between the upper substrate and the lower substrate;

wherein the rectangular and stepwise housing compartment includes a reservoir and an ejection chamber, the ejection chamber having a bottom section forming a through rectangular and stepwise cavity, the rectangular cavity and slant surfaces of the reservoir forming three buffer edges.

13. The bi-direction pumping droplet mist ejection apparatus of claim 12, wherein the reservoir and the ejection chamber are adjacent to a wall which has slant surfaces.

14. The bi-direction pumping droplet mist ejection apparatus of claim 12, wherein the reservoir has a bottom section which has an inlet formed thereon and a through hole formed on another end thereof.

15. The bi-direction pumping droplet mist ejection apparatus of claim 12, wherein the reservoir has a cavity formed on one end to house a clamping pad.

16. The bi-direction pumping droplet mist ejection apparatus of claim 15, wherein the clamping pad clamps the piezoelectric plate.

17. The bi-direction pumping droplet mist ejection apparatus of claim 12, wherein the ejection chamber has a bottom section formed a through rectangular and stepwise cavity for housing the nozzle plate.

* * * * *